US005345869A

United States Patent [19]

Treverton et al.

[11] Patent Number: 5,345,869

[45] Date of Patent: Sep. 13, 1994

[54] LITHOGRAPHIC PLATE, AND METHOD FOR MAKING, HAVING AN OXIDE LAYER DERIVED FROM A TYPE A SOL

[75] Inventors: John A. Treverton, Daventry; Jonathan Ball, Deddington, both of England

[73] Assignee: Alcan International Limited, Montreal, Canada

[21] Appl. No.: 917,045

[22] PCT Filed: Feb. 6, 1991

[86] PCT No.: PCT/GB91/00180

§ 371 Date: Sep. 30, 1992

§ 102(e) Date: Sep. 30, 1992

[87] PCT Pub. No.: WO91/42140

PCT Pub. Date: Aug. 22, 1991

[30] Foreign Application Priority Data

Feb. 12, 1990 [GB] United Kingdom ..... 9003079

[51] Int. Cl.[5] ..... B41N 1/08

[52] U.S. Cl. ..... 101/454; 101/456; 427/419.2; 428/325

[58] Field of Search ..... 101/453–456, 101/458, 459, 463.1, 465–467; 427/376.2, 419.2; 428/325, 329, 402, 469; 501/12, 103

[56] References Cited

U.S. PATENT DOCUMENTS

| | | | |
|---|---|---|---|
| 3,231,376 | 1/1966 | Sorkin et al. | 430/155 |
| 3,364,057 | 1/1968 | Jackson | 427/419.2 |
| 3,419,406 | 12/1968 | Howle et al. | 106/287.1 |
| 3,964,906 | 6/1976 | Kenney | 101/465 |
| 3,975,197 | 8/1976 | Mikelsons | 101/456 |
| 4,330,605 | 5/1982 | Boston | 430/302 |
| 4,445,998 | 5/1984 | Kanda et al. | 101/463.1 |
| 4,456,670 | 6/1984 | Nakayama et al. | 430/49 |
| 4,457,971 | 7/1984 | Cadwell et al. | 428/323 |
| 4,585,529 | 4/1986 | Kanda et al. | 204/27 |
| 4,614,673 | 9/1986 | Bendig | 427/376.2 |
| 4,820,593 | 4/1989 | Egerton et al. | 428/325 |
| 5,034,358 | 7/1991 | MacMillan | 427/376.2 |

FOREIGN PATENT DOCUMENTS

| | | | |
|---|---|---|---|
| 64597 | 4/1982 | Japan | 101/459 |
| 1174648 | 12/1969 | United Kingdom . | |
| 1342893 | 1/1974 | United Kingdom . | |
| 2111698 | 7/1983 | United Kingdom . | |

OTHER PUBLICATIONS

Ramsay, J. F. D., Neutron and Light Scattering Studies of Aqueous Solutions of Polynuclear Ions.

Database WPIL, No. 90-070935, Derwent Publications Ltd., London, GB; & JP-A-02-23347 (Konica Corp.) Jan. 1, 1990.

*Primary Examiner*—Edgar S. Burr
*Assistant Examiner*—Stephen R. Funk
*Attorney, Agent, or Firm*—Cooper & Dunham

[57] ABSTRACT

A lithographic plate comprising a substrate carrying an oxide layer derived from a Type A sol is disclosed. The substrate may be metal, e.g. aluminum or steel, and may be in a mill finished state or grained or otherwise profiled. Type A sols have polynuclear cations but no specific particles and may be formed by peptising basic salts with acids. The sol may include an inorganic passenger powder which may impart a desired topography to the coating layer.

16 Claims, No Drawings

LITHOGRAPHIC PLATE, AND METHOD FOR MAKING, HAVING AN OXIDE LAYER DERIVED FROM A TYPE A SOL

This invention concerns a method of preparing the substrate of lithographic printing plates, and lithographic plates so prepared, which eliminates the need to electrograin and anodise but is capable of producing a range of controlled topographies and high quality plates.

BACKGROUND OF THE INVENTION

Lithographic printing processes rely on the differential wetting characteristics of hydrophobic and hydrophilic surfaces. In practice an aluminum surface is roughened, anodised, conditioned and then coated with a light sensitive coating. Positive and negative images are normally formed on the surface of the printing plate by photographic methods. Development of the image results in removal of the organic coating from either the exposed or unexposed areas. The organic areas are oleophilic and will accept oil-based inks but will not water wet. In contrast the conditioned anodic oxide has a high surface energy and can accept either water or ink, however, when wet it will not accept ink. The roughening stage is critical for print quality and requires uniform topographies with surface features in the range 0.01–4 μm. The actual range employed for any particular plate depends predominantly on the quality of paper and required print finish.

The most common method of achieving the high standard of roughening required for lithographic plates is to electrochemically treat the surface. However, the process has several limitations. Specifically it can only be run at slow speeds and it requires very high quantities of electrical power and the use of specialist materials. Production of these materials demands special and costly practices in order to ensure the high quality of the final product. Also, expensive waste treatment plant is required to treat the waste chemicals from anodising and graining aluminum. The present invention will increase line-speeds, require less power usage, will eliminate costly production methods, increase the range of alloys that can be used to make lithographic printing plates, and permit the use of other metallic and non-metallic substrates. Also, the treatment is environmentally good as it does not give rise to significant waste disposal problems.

It is known to prepare a lithographic printing plate by applying to a substrate a suspension or sol of preformed particles, and removing the liquid to leave a coating comprising the particles. The particles may be bound together by means of a polymer or by partial sintering, but organic polymers may affect the hydrophilic lipophilic balance of the surface while partial sintering may require heating to such high temperatures as to damage the substrate. Particulate surface coatings of this kind are described in U.S. Pat. No. 4,293,625; 4,330,605; 4,445,998; 4,456,670; 4,457,971; 4,420,549; 4,542,089; and 4,687,729.

U.S. Pat. No. 3,231,376 describes a lithographic plate coated with a Type B sol derived from a titanium or zirconium alkoxide.

U.S. Pat. No. 3,419,406 describes a lithographic plate comprising a grained aluminum substrate coated with a sol derived from an alkyl titanate. The grained substrate is responsible for the surface topography.

U.S. Pat. No. 4,522,912 describes a lithographic plate in which a metal substrate carries an electrodeposited chromium layer of rough crag-like character with recesses covered by glass-like films derived from an ammonium zirconate carbonate solution.

SUMMARY OF THE INVENTION

In one aspect the present invention provides a lithographic plate comprising a substrate carrying an oxide layer derived from a type A sol which is itself derived from an inorganic precursor.

In another aspect the invention provides a method of making a lithographic plate, which method comprises applying to a substrate a fluid composition comprising a type A sol derived from an inorganic precursor and curing the composition to form an oxide layer on the substrate.

Type A sols consist of basic units which are polynuclear ions which form an inorganic polymer and are formed by hydrolysis and polymerisation of monomeric cations. The molecular weight of the polynuclear cations will depend on the degree of hydrolysis but these sols normally have an anion to metal ratio of approximately 1:1. The polymeric species are not large enough to scatter light efficiently, so the sol and the resultant gel are optically clear. The gel has a high density, low porosity and the x-ray diffraction pattern consists of very broad bands. See J. D. F. Ramsay "Neutron and Light Scattering Studies of Aqueous Solutions of Polynuclear Ions. Water and Aqueous Solutions", 207–218 1986 (ed G. W. Neilson and J. E. Enderby: Bristol. Adam Hilger). Type A sols may be formed from the polynuclear ions listed in this paper including those containing Al(III) Fe(III) Zr(IV) Th(IV): for example:

$Al_{13}O_4(OH)_{24}(H_2O)_{12}^{7+}$.

Type B sols consist of basic units or particles with a definite shape, e.g. spherical, rod or plate-like, and which are amorphous or microcrystalline. The sol is formed by extensive hydrolysis of a salt and has a low anion to metal atom ratio of approximately 0.3:1. The sols can also be prepared by peptization of fresh precipitates. The colloidal units are not aggregated and the sol and the resultant gel may both be clear. Type B sols include Al(III) Zr(IV) Ce(IV) Ti(IV) Fe(III). Preparation of Type B Al(III) sols is described in GB 1,174,648. Preparation of Ce Type B sol is described in GB 1,342,893. Type B Alumina Sols are available commercially.

In the type C sol the basic colloidal units are aggregated. They are crystalline and the gels formed by removal of water have a low density. These sols scatter light and are therefore opaque. The sols formed from ultrafine powders prepared by vapour phase techniques, i.e. flame hydrolysed powders, belong to this category.

Type A and B sols when dehydrated yield gels which are >45% of the theoretical density of the oxide. The gels derived from a type C sol are porous and have a density <45% of the theoretical density of the oxide.

The inorganic sol for use in this invention is a hydrous oxide sol, preferably a hydrous metal oxide sol, that is to say a Type A (but not Type B or Type C) sol. Examples are zirconia sols, ceria sols, titania sols, hafnia sols, alumina sols, and iron oxyhydroxide sols. Silica sols exemplify non-metal oxide sols.

Zirconia Type A sols are readily formed by peptising basic zirconium carbonate in mineral acid. The constitution of zirconia sols when the associated anion is nitrate or bromide or chloride is discussed in a UKAEA Research Group Report, reference AERE-R5257 (1966) by J. L. Woodhead and J. M. Fletcher. Zirconia sols contain extensively hydrolysed inorganic polymers with a primary particle size of less than 10 nm. The polymer is thought to be built up of hydrated oxyhydroxide species of zirconium. When nitric acid is used, the species is believed to have the formula:

$$[Zr_4(OH)_{12}(NO_3)_2(H_2O)_4]_n\,(NO_3)_{2n}.2nH_2O,$$

where n is thought to be approximately one in dilute sols and greater than one at higher concentrations. Ceria and titania and other hydrous metal oxide Type A sols may be formed by peptising the corresponding hydrated metal oxide with a mineral acid. Alumina type A sols may be prepared by denitration of an aqueous aluminium nitrate solution using an organic water-immiscible amine such as that sold under the Trade Mark PRIMENE JMT.

Type A sols can also be formed by controlled hydrolysis of metal alkoxides. The alkoxide is provided in solution in an organic solvent, and a controlled amount of water added to form polynuclear cations. The same technique is available for forming type A silica sols from organic solutions of alkoxysilanes. However, this route is unsatisfactory; organic groups may need to be removed from the coating; organic solutions are a fire hazard. The Type A sols used in this invention are derived from inorganic precursors (including carbonates).

On gelling Type A sols, the polynuclear cations polymerise by a chemical reaction to form a crosslinked inorganic network. By contrast on gelling type B or type C sols, the sol particles merely aggregate or physically fuse together. As a result, coatings formed from type A sols are more coherent than those formed from type B or type C sols, and without the need to cure at temperatures high enough to sinter the particles.

The nature of the substrate is not critical. Substrates which are conventionally used for lithographic plates may be used in this invention. The most common substrate is aluminum sheet, but other metals including steel are used, as are plastics sheet, metallised plastics and even paper. Metal substrates may carry a continuous electroplated coating e.g. of nickel or chromium. The aluminum or steel or other substrate may have a grained or profiled surface, but it is an advantage of the invention that the substrate may be used in a mill finished state or otherwise as supplied, without the need for special surface profiling.

Also applied to the surface, according to one aspect of the invention, is a fluid which gels the sol and/or a powder passenger on the surface. For example, $Al_2O_3$ Type B or C sol powder passenger may be gelled on the surface by phosphoric acid. This fluid may be in the vapour phase, for example a low molecular weight amine such as ethylamine or preferably ammonia, which is applied after the composition and simply serves to gel and thereby fix the layer on the surface. More preferably, the fluid is a liquid, particularly an aqueous liquid containing a gelling agent for the sol. This liquid may be applied to the surface to deposit the gelling agent thereon, prior to application of the sol. Alternatively, the liquid can be applied to the surface already carrying a layer of the sol. It is preferred, though not essential, that the layer of sol be dried prior to application of the gelling fluid. Gelling of the layer causes or may cause shrinkage, and care may need to be taken to prevent cracking of the layer at this stage. Drying may be effected at temperatures below 100° C., conveniently at ambient temperature.

The composition may also contain a powder passenger, which can be used to give the protective coating a desired surface topography. The powder is preferably an inert metal oxide such as silica, zirconia, titania or alumina. This may be a type C sol, or a powder produced by comminution, for example. Powder loadings of 1 to 300 $gl^{-1}$, preferably 5–150 $gl^{-1}$, more particularly 10–75 $gl^{-1}$ are appropriate. The powder may have an average particle size below 10 μm, preferably below 5 μm, e.g. in the range 3–500 nm, and is preferably of substantially uniform particle size. When a fluid brings about gelation of the sol, the powder becomes incorporated in the layer on the substrate surface.

The oxide layer is sufficiently hydrophilic to be capable of being wetted by water. The texture and thickness of the layer are such that it is capable of holding water to an extent to prevent deposition of lipophilic inks. The roughness of the surface should not be so great as to impair print definition, or to give rise to abrasion or ink pick up on high spots. These factors affect size and loading of the powder passenger.

The composition generally has an acid pH, typically in the range 1.5 to 7. Sol concentration is chosen to achieve a convenient application viscosity. The sol may typically contain from 1 to 200 $gl^{-1}$ metal oxide equivalent.

The surface to which the composition is to be applied may be cleaned by conventional means appropriate to the substrate concerned. For aluminum this may be an acid or alkaline cleaning treatment, using commercially available chemicals such as those sold by ICI under the trade marks RIDOLENE 124 and 124E. Alternatively, the metal surface may be pretreated to form thereon an artificially applied oxide layer. Such treatments include acid etching (Forest Products Laboratories), and anodising treatments with sulphuric, chromic or phosphoric acid. It has been shown by means of transmission electron microscopy that phosphoric acid anodising treatment produces fine oxide protrusions of greater length and magnitude than other surface treatments. This pretreatment may help to extend lithographic plate life. By virtue of their small sol unit size, the aqueous compositions of this invention can be applied to such profiled surfaces in layers so thin and uniform that the profiled surface topography is substantially maintained. It is believed that the artificially applied oxide layer provides improved initial adhesion for subsequently applied artificial coatings by mechanical interlocking.

The sol may itself provide a desired degree of profiling to a smooth substrate, either of itself or by virtue of containing a suitable powder passenger. Or a sol without a powder passenger may be applied to a profiled substrate, and form thereon a uniform coating which maintains the profiling and protects it from abrasion. Or profiling may result in part from a profiled substrate and in part from a powder passenger contained in the sol. What is not envisaged is an excessively rough or profiled substrate with a solderived deposit merely filling in holes and pores of the substrate.

The composition may be applied to the substrate surface (optionally carrying a profiled surface) by any convenient technique, such as spin coating, immersion, flow or roller coating, brushing, or by spraying. For aluminum strip, roller coating is likely to be an attractive option. The formulation may need to be adjusted to provide a convenient viscosity for application by the desired method. After application and drying, the coating on the surface is cured. Curing temperatures are from ambient up to 700° C., usually (though not always) below those required to fully sinter the particles, and may typically be at a temperature in the range 50° to 400° C. at which the substrate is stable. Calcination of the coating at temperatures above 400° C. is possible but not usually necessary. Removal of water takes place progressively and is still not complete at 400° C.

The surface preferably carries the coating at a rate of from 0.01 to 5 $gm^{-2}$, preferably between 0.02 and 1.0 $gm^{-2}$, and most preferably from 0.05 to 0.7 $gm^{-2}$. If more pronounced surface texture is required, thicker coatings e.g. of up to 5 $gm^{-2}$ may be preferred and passenger powders with average particle sizes up to 1 micron or even up to 10 microns may be used. The invention envisages as an additional method step the application to the oxide layer of one or more subsequent layers such as are conventional in lithography.

The lithographic sheet may comprise a photosensitive layer on the oxide layer. This may be applied by the manufacturer before distribution; or by the user by a wipe-on-technique before use. When using silver salt diffusion transfer principles, the lithographic plate may comprise a silver-receptive layer on the oxide layer.

Description of the Preferred Embodiments

The following examples illustrate the invention. Preparation of the sols is described in EPA-358338 published on Mar. 14, 1990 and to which reference is directed.

EXAMPLE 1

Sols were deposited on AA1050A alloy at 0.4 mm gauge in either the as rolled or as commercially grained condition. The plates produced were;

| | | |
|---|---|---|
| A | 5% Zirconia sol | Electrograined sheet |
| B | 5% Zirconia sol | As rolled sheet |
| C | 2.5% Zirconia sol and 2.5% Bacosol (Bohmite) | As rolled sheet |
| D | 2.5% Zirconia sol and 2.5% Bacosol (Bohmite) | As rolled sheet |
| E | 5% fumed silica (A200) and 5% Zirconia Sol | As rolled sheet |

A positive light sensitive coating (Esterified resin of 2,1-naphthoquinone-diazide-5-sulphonic acid) was applied as the recommended 10 wt % solids content solution in Cellosolve. Bar coating was used to apply the coatings and the approximate film weight was 4 $gm^{-2}$. In general control over the uniformity of the films deposited was not optimised; specifically, in examples A and B, coatings were thinner than optimum.

A series of standard test images designed to show the resolution and range of tones were developed on to the plates using standard UV exposure/developing techniques. Exposure time was 75 seconds in a Howson Algraphy Apollo contact printer and Howson Algraphy "Posidev" solution was used to develop the plates. For comparative purposes, a standard Howson Algraphy "Super Amazon" plate was also developed. After development the plates were coated with synthetic gum.

Printing Trails

Printing trials were carried out on a single stand of a five-colour Heidelberg Offset Lithographic Printing Press. Preliminary trails with an uncoated plate A showed total "Blocking out" of the non-image area, i.e. ink was deposited on all areas of the plate and not lifted from the sol-gel coated non-image area. A separate fountain solution, applied to the plate in addition to the ink, normally wets the non-image area preventing ink adhesion. During the course of the work it was established that the treatment with the developer which contains sodium metasilicate overcame "blocking out".

For the printing tests the plates were mounted "side-by-side" in the press and 320 impressions made. Impressions from the C, D and E treated plates were of almost identical quality to those obtained from the commercial Howson "Super Amazon" plate. It should be noted that the Howson plate is one of the best available commercially. Poorer quality (but acceptable) impressions were obtained from examples A and B but this was attributed to the low thickness of the original photoresist on the plate surface. None of the plates showed any deterioration during the print run. Throughout the trials the fountain solution was used at a minimum rate. In addition, during each trial the fountain solution was turned off until complete "blocking out" of the plates had occurred. Low fountain solution levels were then restored and recovery of the plates recorded. It was also observed that at very low fountain solution levels the commercial plate was tending to "block out". This did not happen on any of the test plates.

Examples 2–20

Sol Preparation a) Zirconia Sol

In a typical preparation 2 kg of zirconium carbonate (44.8 w/v $ZrO_2$, 7.2 moles) was added with stirring to 0.91 of 8M $HNO_3$ (7.2 moles). The paste rapidly dissolved (exothermic 43° C.) to give a sol containing 444 $gl^{-1}$ $ZrO_2$ equivalent. When cooled to 20° C. the dispersion ($NO_3/ZrO_2$ mole ratio = 1.0) has a viscosity of 16 centipoise and a density of 1.55 $g/cm^3$.

For coating the sol was diluted to 25% or 1% of the original concentration.

b) Ammonium zirconium carbonate (AZC)

Obtained commercially.

c) Titania Sol

In a typical preparation 2.8M titanium (IV) chloride is added to ammonium hydroxide to form a gelatinous precipitate of titanium (IV) hydroxide. Following water washing a controlled amount of nitric acid is added to condition and peptise the hydrous colloidal titania sol. The colloidal particles are 50–250 nm in size and comprise 5–10 nm crystallites of anatase.

d) Titania P-25

Titania P-25 comprising of anatase particles with an average primary size of 30 nm was obtained commercially.

e) Ceria Sols

This sol was formed by controlled aqueous deaggregation of ceria hydrate. Nitric acid is added to a slurry of ceria hydrate in water to deaggregate particles into their primary crystallites. Following coagulation excess nitric acid is decanted and water is added to form the sol. The concentration of the sol formed is 400 g/l and its density is 1.4 g/cm$^3$.

f) Iron (III) Oxide

The method of preparation is similar to that described for titania sol. The precursor was hydrated iron (III) nitrate. This forms a type A sol.

g) Silica Sol 12 nm particle size Aerosil 200 was obtained commercially.

h) 'Syton' Silica Sol

Silica in the form of non-aggregated spherical particles with diameters approximately 25 nm was obtained commercially.

Additions

Low sodium Bacosol 3A and 3C were obtained commercially and comprise aluminum oxide monohydrate (Bohmite) particles of 0.1–0.2 μm. Bacosol 3A has a pH of 10 and 3C 3.5. Both are Type B sols.

Coating

Sols were either bar coated or whirler coated at 5 Hz on to AA1050A alloy at 0.4–0.3 mm gauge in either the as rolled or as commercially grained condition.

A positive light sensitive coating (Esterified resin of 2.1-naphthoquinone-diazide-5-sulphonic acid) was applied as the recommended 10 wt % solids content solution in Cellosolve. Bar coating or whirler coating at 5 Hz gave film weights of approximately 4 gm$^{-2}$.

Plate Testing

Prior to light sensitive coating all plates were screened by simple sellotape testing. The resistance of the plates to chemicals used during printing and developing was evaluated by spotting the concentrated solutions on to the plate for periods of 60 seconds and 1 hour.

A series of standard test images designed to show the resolution and range of tones were developed on to the plates using standard UV exposure/developing techniques. Exposure time was 75 seconds in a Howson Algraphy Apollo contact printer and Howson Algraphy "Posidev" solution was used to develop the plates. After development the plates were coated with synthetic gum.

Developer resistance of the light sensitive coated plates were evaluated by spotting the concentrated developer solution on to the test areas of the plate for periods of 15, 30 and 60 seconds and observing the removal of the developed photoresist.

Results showed that some removal of the photoresist on the thinner coatings occurred. Thicker coatings, however remained almost unchanged.

Printing Trials

Printing trials were carried out using suitable plates on a single stand of a five-colour Heidelberg MOFP Offset Lithographic Printing Press. Apart from evaluating the printing characteristics of the plates, the effect of varying the amount of fountain solution was examined. In addition, wear trials were carried out in which excess pressure was loaded onto the blanket by over packing. The non-compressible blanket was over packed by 0.15 mm over a 210 mm section. From previous experience such loading results in a ten fold acceleration in the wear rate of the plate.

Examples

Pure Type A sols

2. A 1050A aluminum alloy in the as rolled condition was cleaned in sodium hydroxide solution and whirler coated with a 25% dilution of the pure zirconia sol using the method described above. The light sensitive coating was also applied by whirler coating and after drying an image developed. In the accelerated printing trial the non-image area started to wear after 4,000 impressions but loss of acceptable printing performance did not occur until 12,000 impressions.

3. In a similar test to that described in Example 2, the non image area of a plate coated with a 40 g/l ammonium zirconium carbonate sol started to wear after 2,000 impressions but loss of acceptable printing performance did not occur until 11,000 impressions.

4. In a similar test to that described in Example 2, the non image area of a plate coated with a 40 g/l iron (III) sol started to wear after 2,000 impressions but loss of acceptable printing performance did not occur until 10,000 impressions.

5. A plate formed by bar coating a 5% zirconia sol on to alkali cleaned, commercially electrograined sheet gave high quality images on printing.

6. A plate formed by bar coating a 5% zirconia sol on to alkali cleaned, as-rolled sheet gave high quality images on printing.

Type A sols with Type B sols as powder passengers

7. In a similar test to that described in Example 2, the non image area of a plate coated with a 2.5% zirconia sol and 2.5% Bacosol 3C sol started to wear after 4,000 impressions but loss of acceptable printing performance did not occur until 23000 impressions.

8. In a similar test to that described in Example 2, the non image area of a plate coated with a 10% zirconia sol with 5% Bacosol 3C sol started to wear after 2000 impressions but loss of acceptable printing performance did not occur until 14,000 impressions.

9. In a similar test to that described in Example 2, the non image area of a plate coated with a 5% zirconia sol with 1% p-25 titania sol started to wear after 7,000 impressions but loss of acceptable printing performance did not occur until 19,000 impressions.

10. In a similar test to that described in Example 2, the non image area of a plate coated with a 10% zirconia sol with 1% Aerosil 200 silica sol started to wear after 3,000 impressions but loss of acceptable printing performance did not occur until 11,000 impressions.

11. In a similar test to that described in Example 1 but using 304 stainless steel as the substrate, the non image area of a plate coated with a 10% zirconia sol with 10% Bacosol 3C sol started to wear after 2,000 impressions but loss of acceptable printing performance did not occur until 14,000 impressions. Prior to coating the stainless steel was cleaned by Scotch-Brite brushing and trichloroethylene degreasing.

12. A plate formed by bar coating a 2.5% zirconia and 2.5% Bacosol 3A on to alkali cleaned, as-rolled sheet gave high quality images on printing.

Comparative Tests

Type B Sols

13. In a similar test to that described in Example 2, the non image area of a plate coated with a 40 g/l titania sol started to wear after 1,000 impressions but loss of acceptable printing performance occurred by 3,000 impressions.

14. In a similar test to that described in Example 2, the non image area of a plate coated with a 10% Ceria sol started to wear after 1,000 impressions but loss of acceptable printing performance occurred by 3,000 impressions.

Type C Sol

15. In a similar test to that described in Example 2, the non image area of a plate coated with a 1% Aerosil 200 type C silica was badly reticulated. During printing the reticulated non-image coating picked up ink causing badly marked non-image areas. The same silica performed similarly in a formulation including 10% zirconia sol.

Formulation with Insufficient Type A Sol

16. In a similar test to that described in Example 2, the non image area of a plate coated with a 1% zirconia and 1% P25 titania sol was badly marked by 1,000 impressions.

Plate Clean-up Rates

17. Throughout the tests 2 to 12, the fountain solution was used at a minimum rate. In addition, during tests 5, 6 and 12 the fountain solution was turned off until complete "blocking out" of the plates had occurred. Subsequent application of low levels of fountain solution resulted in the plates cleaning up completely within 25 impressions.

Image Adherence

18. During the development and rinsing stages of manufacture, the image coatings were washed away from plates coated with 2.5 to 10% Syton X30 silica.

Pre-press Screening Tests

19. The sellotape test was applied to all plates produced as a preliminary check of the integrity of the coatings. All of the coatings used in the printing trials passed successfully.

20. Plates coated with following compositions were tested for resistance to the chemicals used in the printing process.

2.5% Ceria ($\approx$410 $gl^{-1}$) sol
2.5% Zirconia sol/2.5% BaCoSol 3C
5% Zirconia ($\approx$435 $gl^{-1}$) sol
2% Zirconia sol
1% Zirconia sol/1% P-25 titania
10% Zirconia sol
25% Zirconia sol
50% Zirconia sol
5% Zirconia sol/1% P-25 titania
5% Zirconia sol/0.5% P-25 titania Plates were found to be resistant to all chemicals for the exposure times normally encountered in printing practices. Most of the plates withstood exposure for periods of up to 1 hour. The exceptions were the developer and deletion fluids but these are extreme tests where commercial plates also failed.

We claim:

1. A lithographic plate comprising:
a substrate;
an oxide layer, said oxide layer directly overlying said substrate and being derived from a Type A sol which is itself derived from an inorganic precursor.

2. A lithographic plate as claimed in claim 1, wherein the substrate is of aluminum metal.

3. A lithographic plate as claimed in claim 2, wherein the substrate is an aluminum sheet which does not require any surface profiling.

4. A lithographic plate as claimed claim 1, wherein the Type A sol is a hydrous metal oxide sol.

5. A lithographic plate as claimed in claim 4, wherein the Type A sol is a zirconia sol.

6. A lithographic plate as claimed in claim 1, wherein the oxide layer contains discrete inorganic particles below 10 μm in diameter.

7. A lithographic plate as claimed in claim 1, including also a photosensitive layer on the oxide layer.

8. A lithographic plate as claimed in claim 1, wherein the substrate is of a metal selected from the group consisting of aluminum and steel.

9. A lithographic plate as claimed in claim 8, wherein the substrate has a grained surface.

10. A method of making a lithographic plate, which method comprises:
providing a substrate;
applying to the substrate a composition comprising a Type A sol derived from an inorganic precursor and;

11. A method as claimed in claim 10, wherein the step of curing the composition applied to the substrate comprises:
heating the composition at a temperature of from 50°–400° C.

12. A method as claimed in claim 9, wherein the Type A sol contains 1–300 g/l of inorganic particles below 10 μm in diameter.

13. A method as claimed in claim 10 wherein the Type A sol is a hydrous metal oxide sol.
curing the composition to form an oxide layer directly overlying the substrate.

14. A method as claimed in claim 11, further comprising:
applying a photosensitive layer on the oxide layer.

15. A method as claimed in claim 8, wherein the substrate is of a metal selected from the group consisting of aluminum and steel.

16. A method as claimed in claim 15, wherein the substrate has a grained surface.

* * * * *